US005699576A

United States Patent [19]

Sohaiby

[11] Patent Number: 5,699,576

[45] Date of Patent: Dec. 23, 1997

[54] EXTERIOR WINDOW CLEANING APPARATUS

[75] Inventor: Frank Sohaiby, Austintown, Ohio

[73] Assignee: Robert S. Tomko, Canfield, Ohio; a part interest

[21] Appl. No.: 418,668

[22] Filed: Apr. 7, 1995

[51] Int. Cl.[6] ..... A47L 1/04

[52] U.S. Cl. ..... 15/103; 15/50.1; 15/98

[58] Field of Search ..... 15/103, 320, 250.11, 15/98, 50.1, 50.2, 50.3, 250.24, 302

[56] References Cited

U.S. PATENT DOCUMENTS

| | | | |
|---|---|---|---|
| 1,674,102 | 6/1928 | Formoso | 15/103 |
| 2,171,721 | 9/1939 | Bingell | 15/250.11 |
| 2,648,866 | 8/1953 | Christos | 15/250.11 |
| 3,298,052 | 1/1967 | Wolfe | 15/302 |
| 3,604,049 | 9/1971 | Hetman | 15/302 |
| 3,775,804 | 12/1973 | Hoener, Jr. | 15/302 |
| 3,803,656 | 4/1974 | Fannon, Jr. | 15/302 |
| 3,999,242 | 12/1976 | Maruyama et al. | 15/103 |
| 4,025,984 | 5/1977 | Hoener, Jr. | 15/302 |
| 4,112,535 | 9/1978 | Wild et al. | 15/302 |
| 4,198,724 | 4/1980 | Fisher et al. | 15/103 |
| 4,797,969 | 1/1989 | Caduff | 15/302 |
| 4,809,384 | 3/1989 | Yokota et al. | 15/103 |
| 5,086,533 | 2/1992 | Kitahara | 15/302 |

FOREIGN PATENT DOCUMENTS

| | | | |
|---|---|---|---|
| 250862 | 4/1964 | Australia | 15/103 |
| 10566 | 1/1979 | Japan | 15/103 |
| 24044 | 12/1993 | WIPO | 15/103 |

*Primary Examiner*—Gary K. Graham
*Attorney, Agent, or Firm*—Harpman & Harpman

[57] ABSTRACT

The present invention is directed to a window cleaning device for large building that will clean multiple windows of the building in a single pass. The apparatus consist of a tubular housing having a water dispenser, scrubbing and window drying equipment within. The apparatus is lowered by cables from the top of the building and pivots from a guide track which is positioned along the buildings perimeter edges. The washing and drying equipment are retractable for disengagement with the window surface after cleaning allowing for repositioning of the device on the building for cleaning purposes.

7 Claims, 3 Drawing Sheets

EXTERIOR WINDOW CLEANING APPARATUS

BACKGROUND OF THE INVENTION

1. Technical Field

This device relates to self-contained window washing apparatus that travels along the exterior of a building to wash vertical and horizontal rows of windows.

2. Description of Prior Art

Prior art devices of this type have relied on a variety of different configurations including power window scrubbing and drying equipment that travels in guide tracks on the building to be manually positioned with power cleaning brushes, see for example U.S. Pat. Nos. 1,674,102, 2,171,721, 4,797,969 and 4,809,384.

In U.S. Pat. No. 1,674,102, a window washing and cleaning machine is disclosed which has a plurality of brush elements and water dispensing elements in a tubular configuration which is positioned within a bracket for oscillation within, all of which is positioned on an extensible arm.

In U.S. Pat. No. 2,171,721 a window cleaning machine is disclosed which has a window scrubbing and cleaning apparatus positioned on a bracket configuration which can be manually pulled across the window surface.

In U.S. Pat. No. 4,797,969 a building exterior cleaning apparatus is disclosed in which the apparatus consist of a housing having a washing chamber, a rinse chamber and a drying chamber relying on a sonic agitator to impart sonic energy onto the cleaning fluid to aid in removal of dirt from the window.

Referring to U.S. Pat. No. 4,809,384 a horizontal moving automatic outer surface cleaning device is disclosed which is positioned on the building surface and carried by engagement means on horizontal rails enabling the carrier to be guided along the rails. The carrier has water spray means for spraying water onto the surface, wiper means for cleaning the surface and a soiled water tank containing soiled water collected as a result of wiping by the wiper means.

SUMMARY OF THE INVENTION

A self-contained window cleaning device for large buildings that is deployed from a guide track in an arcuate path across the building in a descending angular path. The window cleaning device of the invention has a retractable window engagement brush element with multiple spray nozzles and a squeegee assembly for cleaning and drying the windows in one continuous path configuration.

DESCRIPTION OF THE PREFERRED EMBODIMENT

Figure 1:
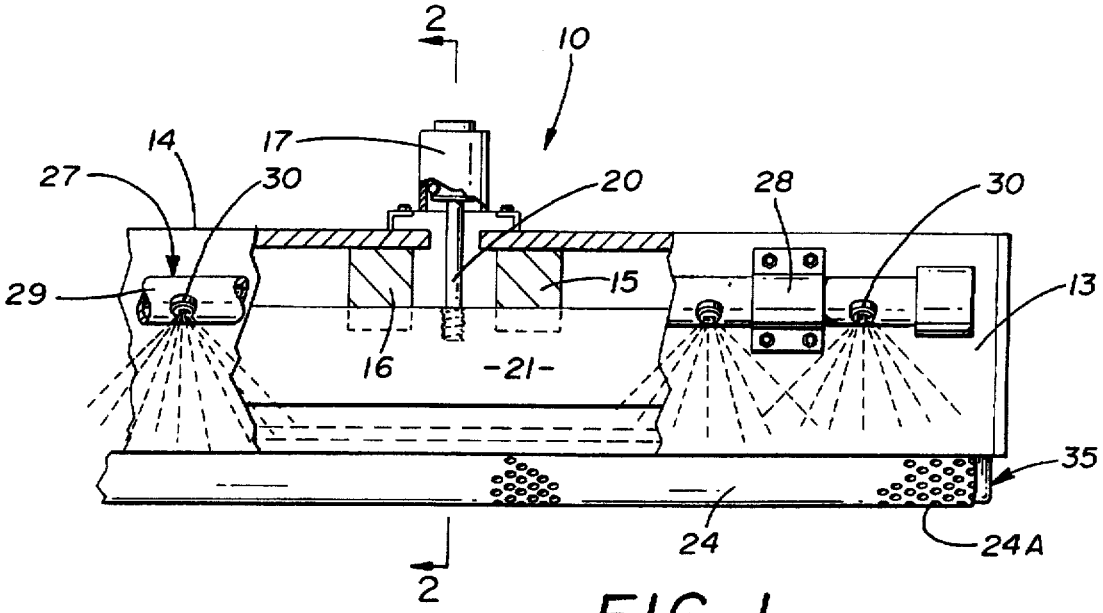
FIG. 1 is a partial cross-sectional view of the cleaning apparatus of the invention.
Figure 2:
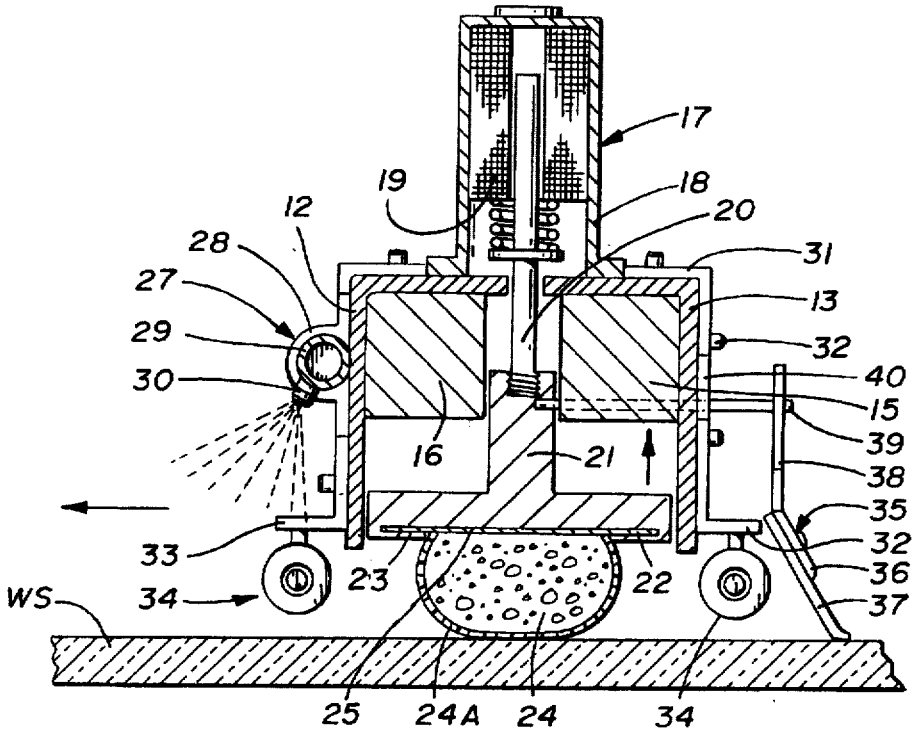
FIG. 2 is a cross-sectional view on lines 2—2 of FIG. 1.

Referring to FIGS. 1 and 2 of the drawings, a window cleaning device 10 can be seen having a plurality of interconnected elongated housing members. Each of the housing members are formed of an inverted U-shaped channel configuration 11 having oppositely disposed sidewalls 12 and 13 and an integral interconnecting top wall 14, best seen in FIG. 2 of the drawings. Pairs of spacing guide blocks 15 are positioned within the channel 11 abutting the top wall 14 and respective sidewalls 12 and 13 defining a plurality of guide slots at 16 therebetween positioned within each of the channel configurations 11. A plurality of solenoid assemblies 17 are positioned on the top wall 14 in longitudinal spaced relation to one another along the channel configurations 11. Each of the solenoid assemblies 17 has a housing 18 and a drive coil 19 with a spring urged actuation rod 20 that extends through the top wall 14 into the channel enclosure as will be well known to those skilled in the art between said hereinbefore described pairs of spacing guide blocks 15.

Each of the solenoid assemblies 17 is connected via its activation rod 20 to an elongated activation bracket 21 within the channel 11 that is of an inverted cross-sectionally T-shaped configuration having opposing mounting grooves 22 and 23 therein. An elongated half-arcuate sponge cleaning element 24 (best seen in FIG. 2 of the drawings) is secured to a support mounting plate 25 that is of a transverse dimension for sliding registration within and between the hereinbefore described oppositely disposed grooves 22 and 23 as will be well understood by those skilled in the art.

The cleaning element 24 has a fabric net 24A wrapped over its exposed surface. The activation bracket 21 is reciprocated vertically within the guide slots 16 from a first window engagement position shown in FIGS. 1 and 2 of the drawings to a second retracted position within the channels 11 as illustrated by the directional arrow in FIG. 2 of the drawings.

A water spray assembly 27 is secured along the sidewall 12 by a plurality of shaped brackets 28 adjacent the top wall 14. The spray assembly 27 has a water supply pipe 29 with a number of longitudinally spaced spray nozzles 30 extending therefrom to provide an overlapping spray pattern of water downwardly and outwardly against the window surface WS to be cleaned. The water supply pipe 29 is connected to a source of water under pressure within the building B, see FIG. 7 of the drawings as will be well known and understood by those skilled in the art.

Figure 7:
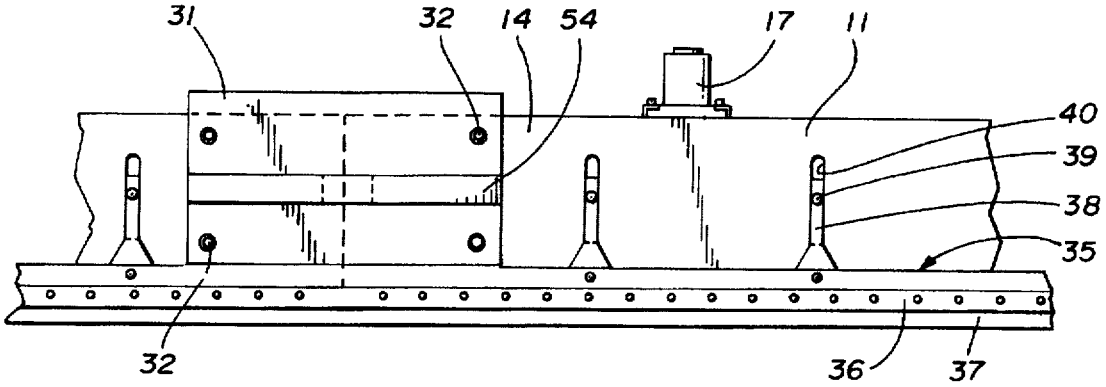
FIG. 7 is an enlarged side elevational view of the window cleaning device shown in FIG. 1.

Each of the hereinbefore described housing sections are secured to one another by interconnecting brackets 31 best seen in FIGS. 2 and 7 of the drawings that are secured to the respective abutting ends of the housings by bolts 32. The interconnecting brackets 31 extend about the respective sidewalls and top wall 12, 13, and 14 respectively of the abutting ends channels 11 and have right angularly extending aperture support flanges 32 and 33 extending therefrom in spaced relation to the window surface WS.

Wheel assemblies 34 are mounted in said apertured flanges 32 and 33 and movably support the assembled interconnecting panels 11 of the window cleaning device 10 in spaced relation to the window surface WS in the retracted position.

Referring back to FIG. 2 of the drawings, a water squeegee assembly 35 can be seen having a rigid support and mounting frame 36 with an elongated flexible rubber window engagement blade 37 mounted therein. The mounting frame 36 has a plurality of angularly offset brackets 38 extending therefrom that are interengageable with rods 39 that extend from elongated slots 40 in the sidewall 13 of the respective channels 11. Each of the rods 39 are secured to activation brackets 21 so as to be reciprocated vertically with the activation bracket 21 as it is moved by the attached solenoid assembly 17 hereinbefore described.

It will be evident from the above description that the sponge 24 and squeegee assembly 36 can be retracted from the window surface as is required during operation allowing the wheel assemblies 34 to engage the window surface as indicated in by the directional arrow in FIG. 2 of the drawings.

Figure 3:
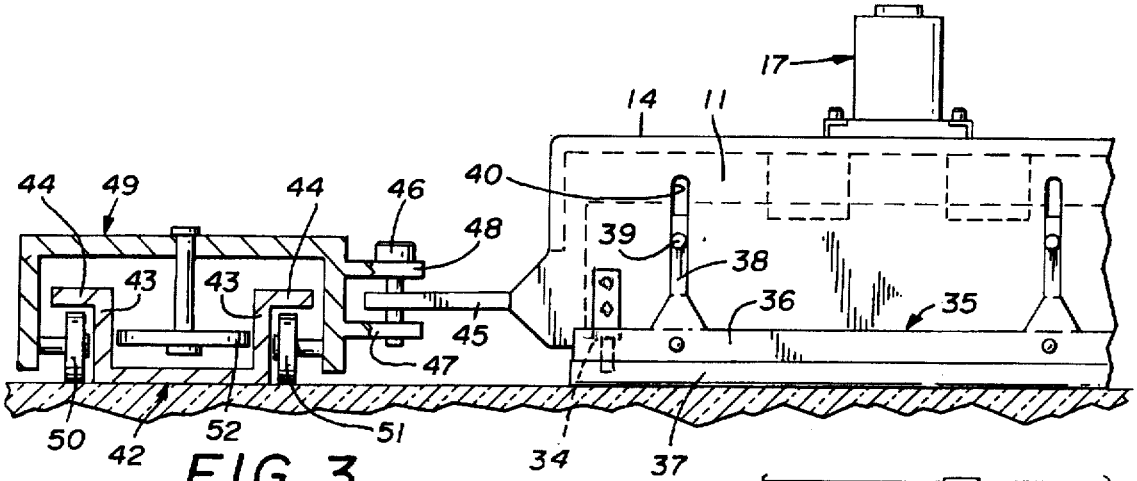
FIG. 3 is a partial cross-sectional view of the main guide track with the cleaning device of the invention pivotally secured thereto.
Figure 4:
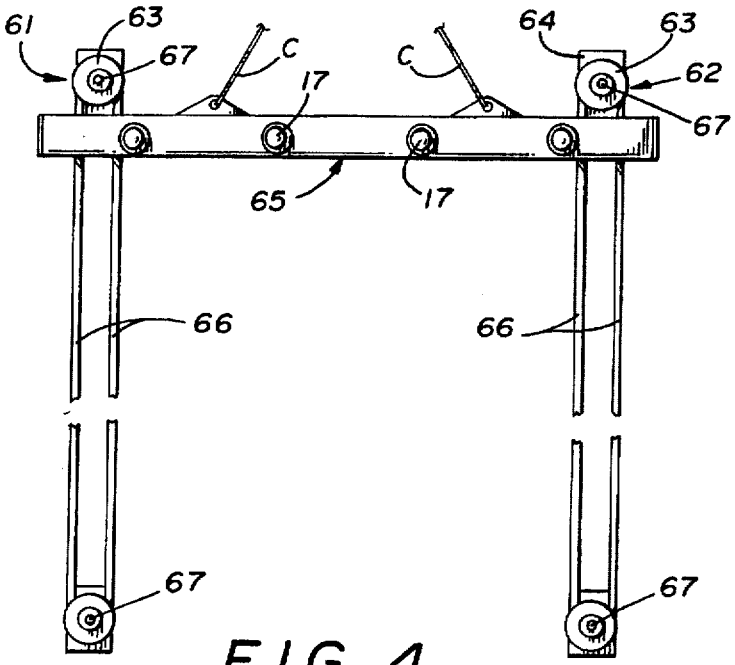
FIG. 4 is a top plan view of an alternate form of the invention positioned for mounting on a building.

Referring now to FIGS. 3 and 7 of the drawings, a guide assembly is shown having a guide track 42 secured to the building B along its perimeter edges E. The guide track 42 has a pair of upstanding elongated oppositely disposed elements 43 each having an out-turned elongated angular flange 44 extending from their respective free ends thereof. The channels 11 have a track mounting element 45 extending from one end adjacent the guide track 42.

The mounting element 45 is apertured pivotally secured thereto by a pivot pin 46 to registered apertured bosses 47 and 48 that extend from a wheel block assembly 49 interengaging on the guide track 42. The wheel block assembly 49 has a pair of vertically disposed support wheels 50 and 51 and a horizontally disposed tracking wheel 52 therein. The support wheels 50 and 51 are caged between the respective elongated angular flanges 44 and the building B with tracking wheel 52 extending horizontally between the upstanding track elements 43 so as to provide free movement along the guide track 42.

In use, the preferred form of the invention is positioned on the pyramid shaped building B being pivotally secured to the guide track 42 by the pivot pin 46 at one end and by a plurality of cables C that extend from the top T of the building B. An apertured cable mounting flange 53 extends from the sidewall 13 of the adjacent interconnected channel 11's free end, best seen in FIG. 6 of the drawings with additional apertured cable mounting flanges 54 extending respectively from said interconnecting brackets 31, best seen in FIGS. 6 and 7 of the drawings.

Figure 8:
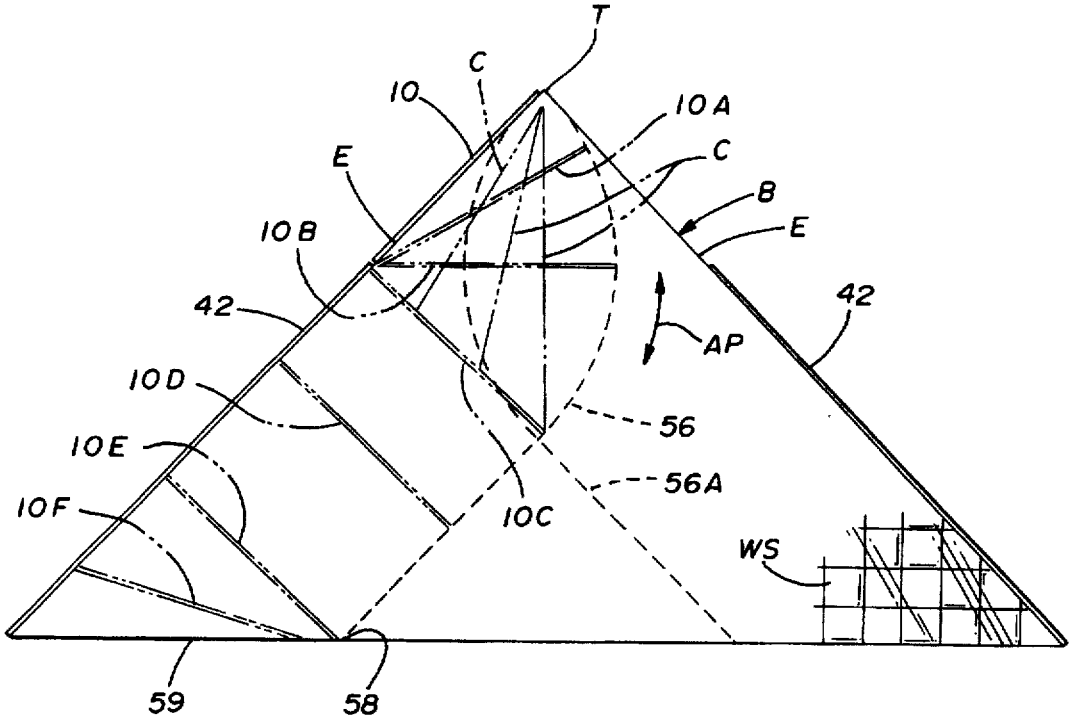
FIG. 8 is a graphic illustration of a building with the window cleaning device positioned thereon illustrating the cleaning paths.

Deployment of the window cleaning device 10 of the invention is best illustrated in FIG. 8 of the drawings wherein the building B is shown having the guide tracks 42 thereon and window cleaning device 10 of the invention shown in solid lines is positioned along the top upper edge of the building B above the guide track 42. In use, as the window cleaning device 10 shown in broken lines is lowered by cables C in an arcuate path indicated by the directional arrow AP, the maximum cleaning area of the window cleaning device 10 is indicated by the dotted line 56 that extends from the building's top T to the point parallel with the end of the guide track 42. As the window cleaning device 10 of the invention descends across the window the window surface WS is sprayed by water from the plurality of nozzles 30 and scrubbed by the advancing sponge 24. As the device passes over the window surface WS the squeegee assembly 35 squeegee's the remaining water from the window surface WS.

Once the window cleaning device 10 of the invention reaches the above referred to point parallel with the end of the guide track 42, a cable C which is secured to the wheel blocks assembly 49 is deployed in unison with the remaining cables C and the window cleaning device 10 descends down the guide track 42 indicated by the incremental intermediate positions illustrated in broken lines of the window cleaning device 10 at 10A, 10B, 10C, 10E and 10F terminating at a position along the base of the building B at 58 and 59 cleaning the window surface WS as it traverses same.

At this point, the solenoid assemblies 17 are activated (by a source of electricity) retracting the sponge cleaning element 24 and interconnected squeegee assembly 35 from the window surface WS so that the window cleaning device can be repositioned at the top of the building B by the cables C for future use.

Once the sponge cleaning element 24 and squeegee assembly 35 is retracted the weight of the window cleaning device 10 is supported by the intermediately spaced wheel assemblies 34 as hereinbefore described.

Figure 5:
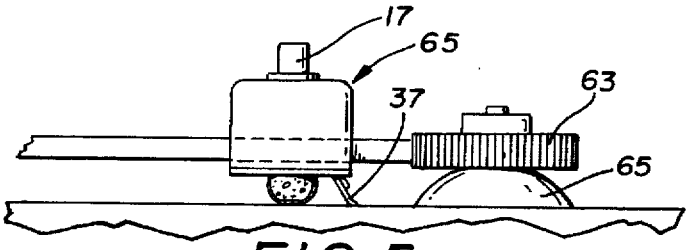
FIG. 5 is a end elevational view of the alternate form of the invention shown in FIG. 4.
Figure 6:
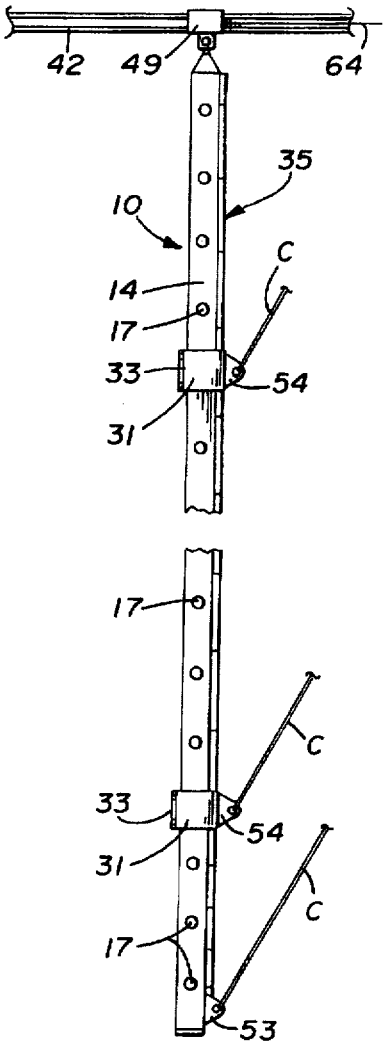
FIG. 6 is a top plan view of the cleaning device of the invention.

Referring now to FIGS. 5 and 6 of the drawings, an alternate form of the invention can be seen wherein a window cleaning device has a pair of guide rod track assemblies 61 and 62 that each have mounting frames 63 and 64 with releasable suction cups 65 extending respectively therefrom. Guide rod pairs 66 extend from said respective mounting frames in spaced parallel relation to one another. A window cleaning assembly 65 tracks on the respective guide rod pairs so as to be movably positioned therealong.

The window cleaning device 65 has a similar construction to said window cleaning device 10 hereinbefore described as will be well understood by those skilled in the art.

Thus it will be seen that a new and useful self-contained window cleaning device has been illustrated and described wherein interconnected channel elements 11 are secured together by interconnecting brackets 31. The assembled window cleaning device 10 is supported from a guide track 42 and a plurality of support cables from the top of the building B. The window cleaning device 10 of the invention provides for a large cleaning pass over the building's windows surface WS beginning with an arcuate sweep at the top of its cleaning path and terminating with a parallel cleaning sweep in relation to the building's edge as it descends.

It will be seen from the above description that a second window cleaning device 10 can be positioned on the opposite side of the building B to provide an overlapping cleaning sweep of the building B as illustrated in FIG. 8 of the drawings by secondary dotted lines 56A.

It will be evident to those skilled in the art that various changes and modifications may be made therein without departing from the spirit of the invention.

Therefore I claim:

1. A window cleaning apparatus for use on large buildings to clean windows thereof, said apparatus comprising; a plurality of identical interconnected hollow housing members together forming a chamber, a retractable window washing engagement means mounted within said chamber and to said housing members for retraction away from said windows into said chamber, a squeegee means extending from said window washing engagement means, said squeegee means retractable with said window washing engagement means away from said windows, a guide track adapted to be mounted on said building, cable support and deployment means adapted to be mounted on said buildings cables extending between and coupled to said deployment means and cable engagement brackets mounted on said housing members, a water spray means mounted on said housing members, means for interconnecting said housing elements to one another, wheel assemblies on some of said housing elements, one of said wheel assemblies registered in said guide track, said support and deploying means adapted to advance said window cleaning apparatus on said track.

2. A window cleaning device of claim 1 wherein said housing members are elongated open channel configurations in end to end aligned registration.

3. The window cleaning device of claim 1 wherein said retractable window washing engagement means comprises; a half arcuate sponge element, a nylon mesh cover on said sponge element positioned on a movable bracket within said housing members and a plurality of solenoid assemblies interconnected to said mounting bracket and a power source coupled with said solenoid assemblies.

4. The window cleaning apparatus of claim 3 wherein said squeegee means comprises; an elongated mounting frame, a resilient rubber blade coupled with said frame, interconnected brackets extending from said mounting frame and joined to said movable bracket within said housing elements by rods.

5. The window cleaning apparatus of claim 1 wherein said water spray means comprises; a water supply pipe coupled with said housing members, a plurality of longitudinally spaced spray nozzles interconnected with said pipe, said spray nozzles positioned as to spray water on the windows to be washed and a source of water under pressure coupled with said pipe.

6. The window cleaning device of claim 5 wherein said water supply pipe and associated interconnected spray nozzles are in oppositely disposed relation to said squeegee means with respect to said housing members.

7. The window cleaning assembly of claim 1 wherein said means for interconnecting said housing elements to one another comprising; interconnecting brackets securing said housings to one another in end to end relationship and wherein all said wheel assemblies, except said one wheel assembly, extend from said interconnecting brackets.

* * * * *